US006244223B1

(12) United States Patent
Welk

(10) Patent No.: US 6,244,223 B1
(45) Date of Patent: Jun. 12, 2001

(54) POWER BURNER TYPE FUEL-FIRED WATER HEATER WITH QUICK CHANGE MANIFOLD ASSEMBLY

(75) Inventor: Gregory M. Welk, Prattville, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/669,294

(22) Filed: Sep. 25, 2000

(51) Int. Cl.[7] ..... F22B 5/00
(52) U.S. Cl. ..... 122/13.01; 122/17.1; 122/17.2
(58) Field of Search ..... 122/13.01, 17.1, 122/17.2; 126/116 R; 431/354, 154

(56) References Cited

U.S. PATENT DOCUMENTS

| | | | | |
|---|---|---|---|---|
| 1,105,338 | * | 7/1914 | Parisen | 122/17.1 |
| 1,517,394 | | 12/1924 | Bengtson . | |
| 1,535,081 | | 4/1925 | Vanorio . | |
| 2,041,683 | * | 5/1936 | Ames | 122/17.1 |
| 4,432,307 | | 2/1984 | Godin | 122/14 |
| 4,545,329 | | 10/1985 | Adams | 122/17 |
| 4,827,899 | | 5/1989 | Walters et al. | 126/41 R |
| 4,836,180 | | 6/1989 | Walters et al. | 126/41 R |
| 6,027,336 | | 2/2000 | Nolte et al. | 431/354 |

* cited by examiner

*Primary Examiner*—Jiping Lu
(74) *Attorney, Agent, or Firm*—Konneker & Smith, P.C.

(57) ABSTRACT

A power burner type gas-fired water heater has a fuel supply manifold which is mounted within a sealed plenum box and supplied with gas from a valve externally mounted on the plenum box and coupled to the manifold via a flex hose disposed within the plenum box and removably connected to the gas valve. By simply removing an access wall portion of the plenum box, uncoupling the flex hose from the gas valve and disconnecting the manifold from associated support structure within the plenum box, the manifold may be removed from the plenum box for replacement of the fuel supply orifices carried by the manifold. This facilitates the field modification of the water heater's input rate and/or fuel type.

15 Claims, 1 Drawing Sheet

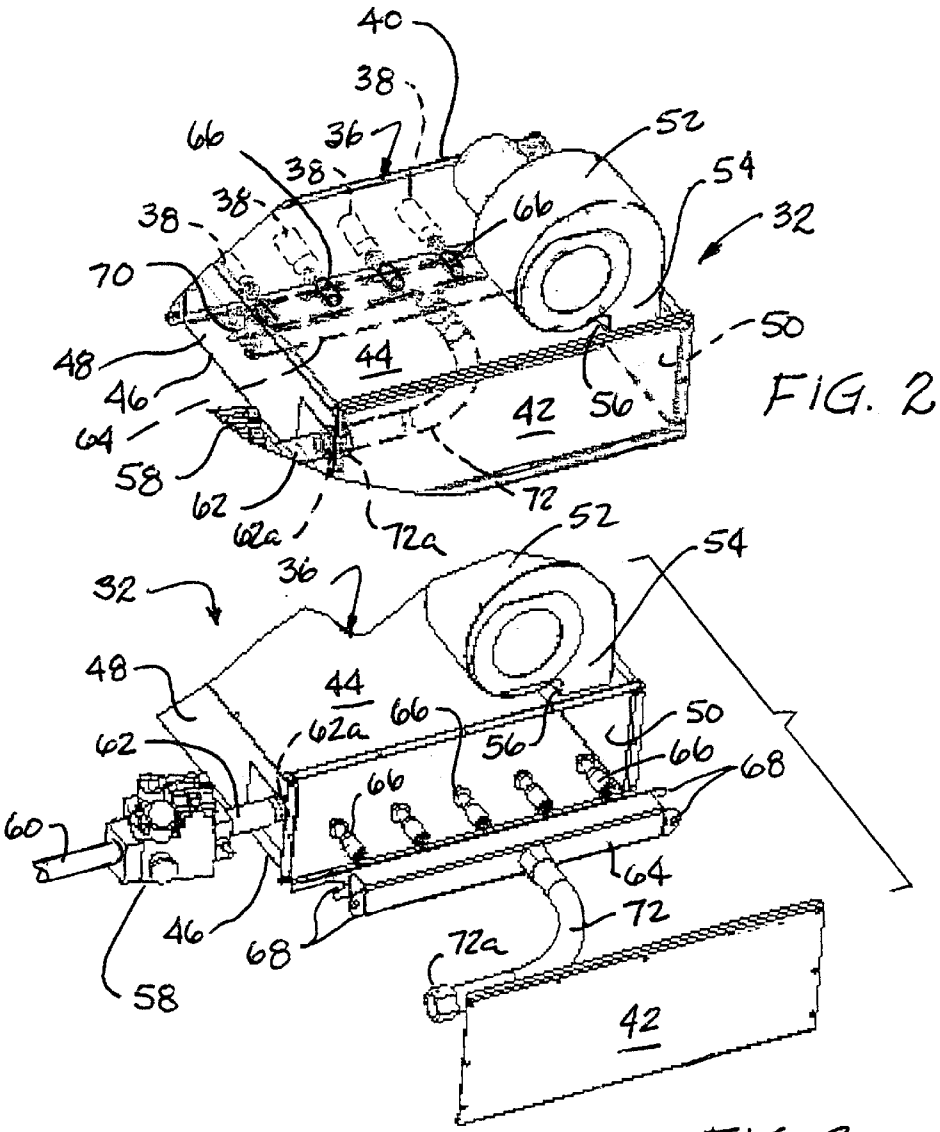
FIG. 2
FIG. 3
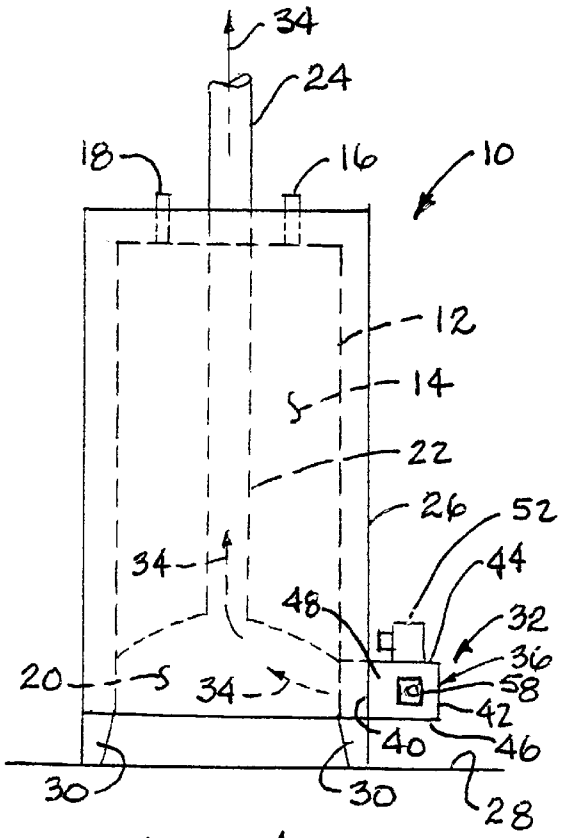
FIG. 1

POWER BURNER TYPE FUEL-FIRED WATER HEATER WITH QUICK CHANGE MANIFOLD ASSEMBLY

BACKGROUND OF THE INVENTION

The present invention generally relates to fuel-fired heating appliances and, in a preferred embodiment thereof, more particularly provides a power burner type fuel-fired water heater having incorporated therein a specially designed quick-change manifold assembly.

Commercial water heaters can be provided with power burner type combustion systems in which a sealed external plenum box projects outwardly from the side of the tank portion of the water heater and is coupled to the outlet of an externally disposed combustion air supply fan that forces combustion air into the interior of the plenum box. The incoming pressurized combustion air is forced through the interior of the plenum box and supplied to fuel burners associated with the plenum box.

Fuel, such as natural/LP or manufactured gas, is supplied to the burners through a fuel valve externally mounted on the plenum box and coupled to a fuel supply manifold supported within the plenum box. A spaced series of fuel supply orifices are carried by the manifold and operate to precisely meter the flow of gaseous fuel to associated ones of the burners for mixture and combustion with the pressurized air being forced through the burners, and into the combustion chamber portion of the water heater, by the air supply fan.

Heretofore, a conventional commercial gas water heater of this type was manufactured in a single input rating and/or gas type (i.e., natural/LP or manufactured gas), and there was no easy way to make field modifications of either the input rating or the fuel input type for the water heater. To effect an input rating change for the water heater, it is necessary to change out the burner orifices carried by the manifold within the sealed plenum box, and for a change in input gas type it is also necessary to change out the fuel supply valve in addition to changing out the orifices.

A major problem associated with a desired change in gas type and/or the input rating of a high capacity commercial water of this type has been one of access to the fuel manifold and the fuel supply orifices which it carries. Specifically, it has heretofore been necessary to remove various structures adjacent the manifold to get to the manifold, and then perform other tedious and time-consuming disconnection tasks to remove the manifold and thereby provide access to its associated fuel supply orifices. For example, it has heretofore been necessary to shut off the gas supply to the gas valve and disconnect the valve from the gas line. Subsequently, these tedious access and disconnection tasks must be performed in reverse to re-assemble the manifold structure and return the water heater to its operational state with its now changed fuel type and/or altered input capacity. Simply stated, conventional water heaters of this type are not designed for or capable of easy field modification.

AS can be readily seen from the foregoing, a need exists for a power burner type fuel-fired water heater having improved manifold access. It is to this need that the present invention is directed.

SUMMARY OF THE INVENTION

In carrying out principles of the present invention, in accordance with a preferred embodiment thereof, a fuel-fired heating appliance is provided with a specially designed power burner assembly in which the internal fuel supply manifold and associated fuel supply orifice portion of the power burner assembly are easily and rapidly accessible for orifice changeout for the purpose of selectively altering the firing rate of the appliance and/or changing the fuel supplied thereto.

The fuel-fired heating appliance, in an illustrated preferred embodiment thereof, is representatively a gas-fired water heater that comprises a tank adapted to hold a quantity of water to be heated, a combustion chamber disposed beneath the tank in thermal communication therewith, and a flue pipe communicated with the combustion chamber and extending upwardly through the interior of the tank.

The specially designed power burner assembly portion of the water heater includes a plenum structure communicated with and extending outwardly from the combustion chamber, the plenum structure having an access opening and a removable access panel sealingly covering the access opening. A gas supply valve is mounted on the plenum structure and has an outlet portion, and a combustion air supply fan has an outlet communicated with the interior of the plenum structure. A spaced plurality of gas burners are incorporated in the power burner assembly, and are operable to receive and combust a gas/air mixture and flow hot combustion products into the combustion chamber. A gas supply manifold is removably connected within the interior of the plenum structure and has an inlet conduit removably connected to the outlet portion of the gas supply valve. The manifold removably carries a spaced plurality of gas discharge orifices which are operatively aligned with the gas burners.

According to a key aspect of the present invention, the power burner assembly is configured to provide rapid and easy access to the orifices, to permit them to be replaced with orifices to change the firing rate of the water heater and/or change the type of gas which is supplied thereto, simply by removing the access panel, respectively disconnecting the manifold and the inlet conduit from the plenum structure and the fuel supply valve outlet portion, and then pulling the disconnected manifold outwardly through the plenum structure access opening to thereby expose the orifices for changeout purposes. In a preferred embodiment of the power burner structure, the disconnected gas supply manifold is removable from the plenum structure without disconnecting the gas supply valve from the plenum structure.

The outlet portion of the gas supply valve is illustratively defined by an outlet pipe extending outwardly from the valve and passing inwardly into the interior of the plenum structure, the outlet pipe having a threaded end portion disposed within the plenum structure. The inlet conduit of the gas supply manifold preferably has an end portion threadingly and removably connected to the end portion of the outlet pipe. According to other features of the invention, the gas supply manifold inlet conduit is representatively a flexible metal hose, the gas burners are representatively inshot-type gas burners, and the gas supply manifold representatively has an elongated hollow body section with opposite end portions removably connected to facing wall portions of the plenum structure.

While principles of the present invention are representatively incorporated in a gas-fired water heater, they may alternatively be employed to advantage in fuel-fired heating appliances of other types including, but not limited to, fuel-fired boilers and air heating furnaces.

BRIEF DESCRIPTION OF THE DRAWINGS

FIG. 1 is a highly schematic side elevational view, partially in phantom, of a power burner type fuel-fired water heater incorporating therein a specially designed quick change manifold assembly embodying principles of the present invention;

FIG. 2 is a perspective view of an external power burner section of the water heater in which the quick change manifold assembly is disposed; and FIG. 3 is a partially exploded perspective view of the power burner section of FIG. 2 from which the fuel manifold structure and its associated fuel supply orifices have been removed.

DETAILED DESCRIPTION

Schematically illustrated in FIG. 1 is a specially designed gas-fired, power burner type water heater 10 having a vertically oriented cylindrical tank portion 12 which is adapted to hold a quantity of heated water 14 for on-demand delivery, via a supply pipe 16 connected to the top end of the tank 12, to hot water-utilizing fixtures such as sinks, dishwashers, tubs and the like. Heated water discharged through the pipe 16 is automatically replaced within the tank 12 via an inlet pipe 18 also connected to the top end of the tank 12.

The tank 12 extends upwardly from a combustion chamber 20, and a flue pipe 22 communicates with the interior of the combustion chamber 20, extends upwardly through a central portion of the stored water 14, and is connected at its upper end to a suitable vent stack 24. An insulating jacket structure 26 surrounds the tank 12, and the water heater 10 is supported on and in an elevated relationship with a horizontal support surface, such as the illustrated floor 28, by a spaced series of depending rails or support legs 30. Alternatively, the bottom of the water heater 10 could be placed directly on the floor 28.

Water heater 10 is provided with a specially designed power burner structure 32 that embodies principles of the present invention and horizontally projects outwardly from the combustion chamber 20. In a manner subsequently described herein, the power burner structure 32 mixes and combusts fuel and air received from sources thereof, and creates hot combustion products 34 which are sequentially forced into the combustion chamber 20 and upwardly through the flue pipe 22 and vent stack 24 to transfer combustion heat through the flue pipe 22 to the stored water 14.

The power burner structure 32 includes a sealed rectangular sheet metal plenum box 36 whose interior is communicated with the interior of the combustion chamber 20 via a horizontally spaced series of Inshot-type gas burners 38 (see FIG. 2). Burners 38 could alternatively be other types of gas burners if desired. Plenum box 36 has a rear side 40 adjacent the burners 38, a sealed, removable front access panel 42, top and bottom side walls 44 and 46, and (as viewed in FIGS. 2 and 3) opposite left and right side walls 48 and 50. A supply air fan 52 has its outlet 54 coupled to a corresponding opening 56 in the top plenum box side wall 44, and is operative to force combustion air into the interior of the plenum box 36. A gas valve 58 is externally supported on the left plenum box side wall 48 and has an inlet pipe 60, and an outlet pipe 62 which forms an outlet portion of the valve 58, is suitable anchored to the side wall 48, and has a threaded outer end 62*a* disposed within the interior of the plenum box 36.

Disposed within the interior of the plenum box 36 is a hollow, horizontally elongated rectangular gas manifold structure 64 which operatively and removably carries, in a conventional manner, a horizontally spaced series of gas metering orifices 66. Connection tab structures 68 are carried on the opposite ends of the manifold 64 and removably secured by screws (not shown) to corresponding mounting brackets 70 on the interior sides of the plenum box left and right side walls 48 and 50. As illustrated, this places the orifices 66 in operative alignment with the Inshot-type fuel burners 38.

A connection conduit, representatively in the form of a flexible steel hose 72, is disposed within the interior of the plenum box 36 and communicates the interior of the gas valve outlet pipe 62 and the interior of the manifold 64. One end of the hose 72 is suitably connected to a horizontally central portion of the manifold 64, and the other end of the hose 72 has a rotatable connection nut portion 72*a* which is removably threaded onto the end portion 62*a* of the gas valve outlet pipe 62. During operation of the power burner structure 32, combustion air forced into the interior of the plenum box 36 is mixed with gas being discharged from the manifold orifices 66, and the fuel/air mixture is combusted and flowed through the burners 38 and into the combustion chamber 20 to form the hot combustion products 34 used to heat the tank water 14.

According to a key aspect of the present invention, the special design of the power burner structure 32 just described substantially facilitates the access to and replacement of the orifices 66 for purposes of changing the firing rate of the water heater 10 and/or changing the type of gas utilized by the water heater. Heretofore, in power burner type gas-fired water heaters, this orifice changeout was simply not a procedure that, as a practical matter, could be carried out in the field. This was due to the fact that a substantial amount of complicated and tedious burner structure disassembly was required to gain access to the orifices. And, of course, a similar amount of reassembly was required to reconstruct the disassembled power burner structure.

In the power burner structure 32 of the present invention, however, access to the orifices 66 is a simple and rapid procedure that may be easily carried out in the field. As may be seen by comparing FIGS. 2 and 3, all that is necessary to gain access to the orifices 66 is to (1) remove the sealed access panel 42, (2) unscrew the manifold end tabs 68 from their mounting brackets 70, (3) unscrew the hose nut 72*a* from the valve pipe end 62(*a*), and (4) pull the entire manifold/orifice assembly 64,66 outwardly through the now open front side of the plenum box 36. It is not necessary to uncouple the valve 58 from the plenum box 36, remove any adjacent parts to gain access to the power burner structure 32, or move any components within the plenum box 32 to gain access to the gas manifold 64.

After the orifices 66 are replaced, all that is necessary is to carry out the simple disassembly steps in reverse order to rapidly and easily reconstruct the power burner structure 32. Specifically, the gas manifold 64 with its new gas metering orifices is simply re-inserted into the interior of the plenum box 36 through its open front side, the manifold 64 is reconnected to its mounting brackets 70, the hose nut 72*a* is threaded back onto the valve pipe end 62*a*, and the access panel 42 is placed back on the open front end of the plenum box 36.

While the power burner structure 32 has been representatively described as being incorporated in a gas-fired water heater, it will be readily appreciated by those of skill in this particular art that it could also be utilized to advantage in other types of fuel-fired heating appliances such as, for example, boilers and fuel-fired air heating furnaces.

The foregoing detailed description is to be clearly understood as being given by way of illustration and example only, the spirit and scope of the present invention being limited solely by the appended claims.

What is claimed is:

1. A fuel-fired heating appliance comprising a chamber for receiving hot combustion products, and power burner apparatus for flowing hot combustion products into said chamber, said power burner apparatus including:

a plenum structure communicated with said chamber and having an access opening, and a removable access panel sealingly covering said access opening;

a fuel supply valve mounted on said plenum structure and having an outlet portion;

a combustion air supply fan having an outlet communicated with the interior of said plenum structure;

a spaced plurality of fuel burners operable to receive and combust a fuel/air mixture and flow hot combustion products into said chamber;

a fuel supply manifold removably connected within the interior of said plenum structure, said fuel supply manifold having an inlet conduit removably connected to said outlet portion of said fuel supply valve; and a spaced plurality of fuel discharge orifices removably carried by said fuel supply manifold and operatively aligned with said fuel burners, said power burner apparatus being configured to provide access to said orifices by simply removing said access panel, respectively disconnecting said manifold and said inlet conduit from said plenum structure and said fuel supply valve outlet portion, and then pulling said manifold outwardly through said access opening.

2. The fuel-fired heating appliance of claim 1 wherein said fuel-fired eating appliance is a gas-fired water heater.

3. The fuel-fired heating appliance of claim 1 wherein:

said outlet portion of said fuel supply valve is defined by an outlet pipe extending outwardly from said fuel supply valve and passing inwardly into the interior of said plenum structure, said outlet pipe having a threaded end portion disposed within said plenum structure, and said inlet conduit of said fuel supply manifold has an end portion threadingly and removably connected to said end portion of said outlet pipe.

4. The fuel-fired heating appliance of claim 3 wherein:

said fuel supply manifold inlet conduit is a flexible hose.

5. The fuel-fired heating appliance of claim 4 wherein:

said flexible hose is a flexible metal hose.

6. The fuel-fired heating appliance of claim 1 wherein:

said fuel burners are inshot-type fuel burners.

7. The fuel-fired heating appliance of claim 1 wherein:

said fuel supply manifold has an elongated hollow body section with opposite end portions removably connected to facing wall portions of said plenum structure.

8. The fuel-fired heating appliance of claim 1 wherein:

the disconnected fuel supply manifold is removable from said plenum structure without disconnecting said fuel supply valve from said plenum structure.

9. A gas-fired water heater comprising a tank adapted to hold a quantity of water to be heated; a combustion chamber disposed beneath said tank in thermal communication therewith; a flue pipe communicated with said combustion chamber and extending upwardly through the interior of said tank; and power burner apparatus operative to flow hot combustion products into said combustion chamber, said power burner apparatus including:

a plenum structure communicated with and extending outwardly from said combustion chamber, said plenum structure having an access opening and a removable access panel sealingly covering said access opening, a gas supply valve mounted on said plenum structure and having an outlet portion, a combustion air supply fan having an outlet communicated with the interior of said plenum structure, a spaced plurality of gas burners operable to receive and combust a gas/air mixture and flow hot combustion products into said combustion chamber, a gas supply manifold removably connected within the interior of said plenum structure, said gas supply manifold having an inlet conduit removably connected to said outlet portion of said gas supply valve, and a spaced plurality of gas discharge orifices removably carried by said gas supply manifold and operatively aligned with said gas burners, said power burner apparatus being configured to provide access to said orifices by simply removing said access panel, respectively disconnecting said manifold and said inlet conduit from said plenum structure and said fuel supply valve outlet portion, and then pulling said manifold outwardly through said access opening.

10. The gas-fired water heater of claim 9 wherein:

said outlet portion of said gas supply valve is defined by an outlet pipe extending outwardly from said gas supply valve and passing inwardly into the interior of said plenum structure, said outlet pipe having a threaded end portion disposed within said plenum structure, and said inlet conduit of said gas supply manifold has an end portion threadingly and removably connected to said end portion of said outlet pipe.

11. The gas-fired water heater of claim 10 wherein:

said gas supply manifold inlet conduit is a flexible hose.

12. The gas-fired water heater of claim 11 wherein:

said flexible hose is a flexible metal hose.

13. The gas-fired water heater of claim 9 wherein:

said gas burners are inshot-type gas burners.

14. The gas-fired water heater of claim 9 wherein:

said gas supply manifold has an elongated hollow body section with opposite end portions removably connected to facing wall portions of said plenum structure.

15. The gas-fired water heater of claim 9 wherein:

the disconnected gas supply manifold is removable from said plenum structure without disconnecting said gas supply valve from said plenum structure.

* * * * *